United States Patent [19]

Cornelis et al.

[11] 4,351,122

[45] Sep. 28, 1982

[54] SYSTEM FOR CONTROLLING THE POSITION OF THE DRAG PIPE OF A DREDGE

[75] Inventors: Christiaan A. Cornelis, Papendrecht; Pieter van Prooijen, Nieuw-Lekkerland, both of Netherlands

[73] Assignee: IHC Holland N.V., Papendrecht, Netherlands

[21] Appl. No.: 118,631

[22] Filed: Jan. 24, 1980

[30] Foreign Application Priority Data

Jan. 25, 1979 [NL] Netherlands ..... 7900595

[51] Int. Cl.[3] ..... E02F 3/88

[52] U.S. Cl. ..... 37/58; 37/72; 37/DIG. 1

[58] Field of Search ..... 37/58, 72, DIG. 1, 195

[56] References Cited

U.S. PATENT DOCUMENTS

| | | | |
|---|---|---|---|
| 1,712,312 | 5/1929 | Sensibar | 37/72 |
| 2,534,917 | 12/1950 | King | 37/58 |
| 2,651,122 | 9/1953 | Brinkman | 37/72 |
| 3,224,121 | 12/1965 | Denning | 37/58 |
| 3,512,281 | 5/1970 | Hadjidakis | 37/72 X |
| 3,739,503 | 6/1973 | Barker et al. | 37/72 X |
| 4,242,815 | 1/1981 | Vermeulen | 37/DIG. 1 |

FOREIGN PATENT DOCUMENTS

| | | | |
|---|---|---|---|
| 31052 | 10/1935 | Netherlands . | |
| 74874 | 6/1954 | Netherlands . | |
| 6706196 | 11/1968 | Netherlands | 37/58 |
| 7304072 | 9/1974 | Netherlands . | |
| 7704643 | 10/1978 | Netherlands . | |

OTHER PUBLICATIONS

McManus, H. P., "Automatic Dredging Controls Designed for Hopper Dredges", *World Dredging*, Jul. 1975, pp. 24–26.

*Primary Examiner*—Clifford D. Crowder
*Attorney, Agent, or Firm*—Young & Thompson

[57] ABSTRACT

Dredge with drag pipe, consisting of a number of pipe sections interconnected by hinged joints, whereby drag lines are connected to said hinged joints and to the front and rear end of the drag pipe and furthermore the rotatably supported front end of the drag pipe is guided into vertical guiding elements at the side wall of the ship and the rear end carries the drag head. The dredge contains for each drag line a separate winch, controlled by an electronic control unit for automatically moving the drag pipe outboard, lowering the rising the drag pipe and moving the drag pipe inboard. During the whole dredge operation from the outboard movement of the drag pipe until the inboard movement thereof the unwound drag line length of each winch is measured, whereby the electronic control unit determines based on said measured drag line length at each moment the position of the drag pipe.

5 Claims, 4 Drawing Figures

SYSTEM FOR CONTROLLING THE POSITION OF THE DRAG PIPE OF A DREDGE

The invention relates to a dredge with drag pipe, consisting of a number of pipe sections interconnected by hinged joints, whereby drag lines are connected to said hinged joints and to the front and rear end of the drag pipe and furthermore the rotatably supported front end of the drag pipe is guided into vertical guiding elements at the side wall of the ship, and the rear end carries the drag head, which dredge contains for each drag line a separate winch, controlled by an electronic control unit for automatically moving the drag pipe outboard, lowering and rising the drag pipe and moving the drag pipe inboard.

Such a dredge with drag pipe is known from the article "Automatic Dredging Controls Designed for Hopper Dredges" published in "World Dredging", July 1975, pages 24–26.

In said article a solution is described for automatically controlling the drag pipe or drag pipe of a dredge. According to said article an electronic control unit is present which control unit responds on a start command by first of all controlling the winches and davits for moving the drag pipe outboard whereafter the drag pipe is lowered until the rotatably supported front end of the drag pipe has reached the lowest position in the vertical guiding elements. Thereafter the suction pumps are started, the drag pipe is filled with water and is lowered further until the drag head reaches the bottom. The fact that the bottom is reached is indicated by a decreasing tension in the drag line connected to the rear end of the drag pipe. During dredging a swell compensator is used to maintain an almost constant tension in said drag line.

After inputting a stop command the drag pipe is raised until it reaches a horizontal position in which the rotatably supported front end is still in its lowest position. Thereafter the pumps are stopped, the drag pipe is emptied and thereafter the drag pipe is raised and moved inboard.

On the one hand the description of said known control system is very brief and on the other hand said system has a number of disadvantages.

In the first place in said abovementioned article nothing is mentioned about the mutual relative movement of the drag pipe sections and the therewith related control of the bend (or bends) in the drag pipe. Practice has proved that an incorrect control of the winches especially related to said bend (bends) can result very easily in damage of the drag pipe or even the total loss of the drag pipe.

Furthermore in said article nothing is said about the preferred ideal position of the drag pipe resulting in optimal dredging.

Furthermore in said article nothing is said about dredging a channel to a specific depth. Also draught variations of the dredge are not taken into account.

An object of the invention is to provide a dredge with drag pipe in which the abovementioned disadvantages are eliminated by using an electronic control unit funtioning such that the production is increased with relative less cost; so that:

1. the ease of control is increased
2. the security is increased and
3. the chances of damaging the installation are reduced to a minimum.

The invention therefore provides a dredge with drag pipe consisting of a number of pipe sections interconnected by hinged joints whereby drag lines are connected to said hinged joints and to the front and rear end of the drag pipe and furthermore the rotatably supported front end of the drag pipe is guided in vertical guiding elements at the side wall of the ship and the rear end carries the drag head, which dredge contains for each drag line a separate winch controlled by an electronic control unit for automatically moving the drag pipe outboard, lowering and arising the drag pipe and moving the drag pipe inboard, characterized in that during the whole dredge operating, from the outboard movement of the drag pipe until the inboard movement thereof the produced drag line length of each winch is measured whereby the electronic control unit determines based on said measured drag line length at each moment the position of the drag pipe.

A preferred embodiment of the invention is characterized in that the electronic control unit controls the winches based on the measurement of the produced drag line length such, that the angle between the hingedly joined drag pipe sections is maintained between predetermined limit values under all circumstances. By assuring that during the outboard movement, the lowering of the drag pipe, the dredging procedure, the raising of the drag pipe and the inboard movement thereof the bending angle between the drag pipe sections is maintained between predetermined limit values, which predetermined limit values may be different for each of the abovementioned phases in the drag pipe movement, it is guaranteed that no situation will arise with a higher chance of damaging the drag pipe.

Further objects and advantages of the invention will become clear in the following description of a preferred embodiment of the dredge with drag pipe comprising an electronic control unit according to the invention, which predetermined embodiment is illustrated in the accompanying drawings.

Figure 1:
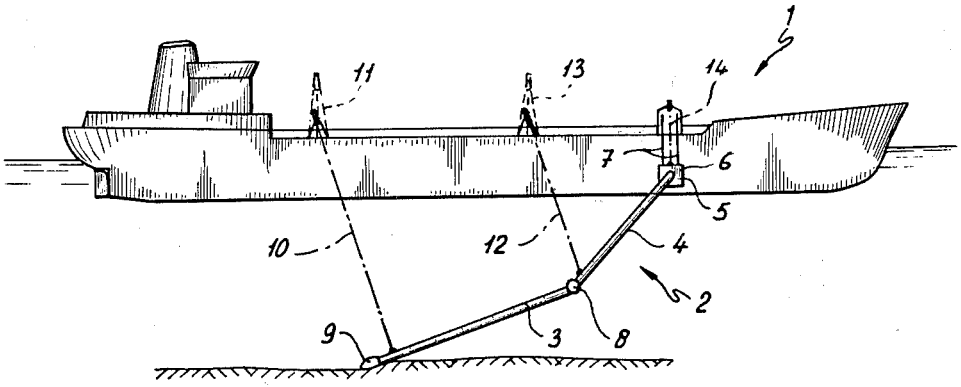
FIG. 1 shows a dredge with drag pipe consisting of a number of mutually hingedly joined drag pipe sections.

FIG. 1 shows a dredge designated by the reference number 1, which dredge contains a drag pipe 2, consisting of hingedly joined drag pipe sections 3 and 4. The drag pipe section 4 is at the one end connected to a curved section 5, which curved section 5 in turn is connected to a flange 6, movably supported by the rails 7 along the ship wall, so that said flange is able to move from a position at the ship's deck level to a lower position along the ship wall where said flange is brought in line with an opening, admitting of being closed, through which the material dredged through the drag pipe is transported into the hold of the ship.

On the other side of the drag pipe section 4 is connected to the other drag pipe section 3 by means of the hinged joint 8. At the other end of said drag pipe section 3 the drag heat 9 is connected. At said end of the drag pipe section 3, to which also the drag head 9 is connected, a drag line 10 is attached guided by the davit 11 and wound on a non-illustrated winch. Near the hinged joint 8 a drag line 12 is connected guided by the davit 13 and wound on a non-illustrated winch. Also the curved section 5, 6 is supported by a drag line 14, wound on a non-illustrated winch.

Figure 2:
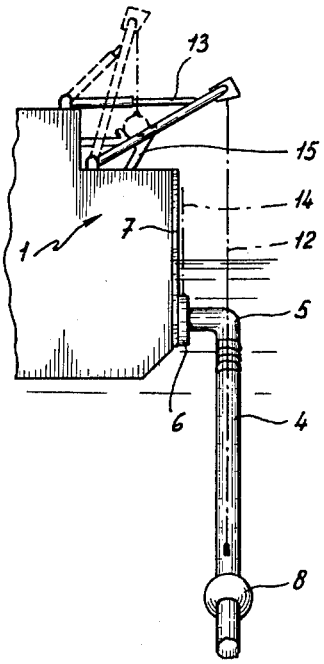
FIG. 2 shows in cross-section how the drag pipe is moved outboard from the inboard resting position and the lowering of the drag pipe.
Figure 3:
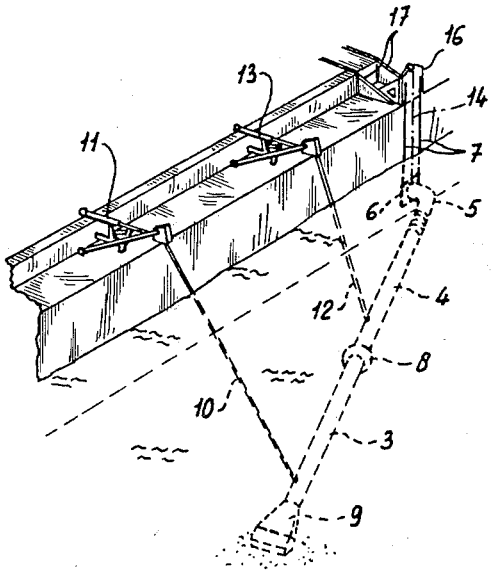
FIG. 3 shows in more detail the drag pipe in the lowered position during dredging.

At the start of the operation of the dredge the drag pipe is placed in guantries 15 on the deck as is schematically illustrated with the dotted line in FIG. 2. FIGS. 2 and 3 show the davit guiding the bend drag line 12 connected near the hinged joint 8 in two positions. With the dotted line the position is shown in which the drag pipe rests on a gantry 15 near the davit. A similar gantry is positioned near the davit 11. The curved section is raised with the drag line 14 guided by the rails 7 until the highest position wherein the flange 6 in fact is supported by a so-called cruve wagon 16, which can be moved along further rails 17 inboard a short distance to carry said curved section to an inboard position during periods when the drag pipe is not used.

To bring the drag pipe to the dredging position first of all the drag pipe must be moved outboard. Therefore the drag pipe is raised from the gantries 15 and is moved outboard by moving the davits 11 and 13 from the position illustrated in dotted line in FIG. 2 to the position illustrated in full line in FIG. 2, and simultaneously moving the curve wagon 16 along the rails 17 to the position shown in FIG. 3. Now the drag pipe is hanging outboard. Thereafter the drag pipe will be lowered maintaining the drag pipe in a nearly horizontal position by unwinding the drag lines 10, 12 and 14 by means of the respective winches until the drag pipe has reached the water level. Experience has shown that in the ideal situation the drag pipe as a whole should make a small angle with the horizontal so that the drag pipe can easily be filled with water and the drag pipe can very gradually pass below the water surface.

After passing below the water surface the drag pipe is lowered further, maintaining the drag pipe in a horizontal position until the curve 5 connected to the flange 6 has reached the input opening in the side wall at which moment the unwinding of the cable 14 is stopped. For the further positioning of the drag pipe only the cables 10 and 12 are unwound by the respective winches, such that the angle between the drag pipe sections 3 and 4 at the hinged joint 8 is maintained within predetermined limits.

Because the mutual positions of the davits 11 and 13 and the curved section 5, 6 are known and furthermore the condition of the swell compensator will be measured it is possible to calculate the exact position of the drag pipe if the unwound length of the drag lines 10 and 12 is known. According to the invention said unwound lengths of the drag lines 10 and 12 are exactly measured and with said measured values and the known fixed position data of the davits 11 and 13 and the curved section 5, 6 and taking into account the condition of the swell compensator, the control circuit calculates continuously the position of the drag pipe and the angle between the hingedly joined drag pipe sections 3 and 4. When it reaches one of said predetermined limit values then the lengths of the drag lines 10 and 12 are, through the respective winches, increased, decreased or maintained steady.

Also during the initial phase of lowering the drag pipe, i.e. the outboard movement and the passing below the water surface the unwound length of the drag lines 10 and 12 and also the unwound length of the drag line 14 are measured taking into account the condition of the swell compensator so that also during said initial phase the preferred position of the drag pipe can be maintained.

If the drag head 9 reaches the bottom then the tension in the drag line 10 will decrease so that the swell compensator, which in itself is a known apparatus, will start functioning indicating that the lowering phase of the drag pipe is concluded. During the following dredging procedure the length of the drag line 10 will be increased or decreased by means of the swell compensator which is known from the state of the art. For further details of such a swell compensator, attention is drawn to U.S. Pat. No. 3,512,281.

During the raising of the drag pipe when the dredging procedure is stopped, the inverse of the lowering procedure will be carried out. First of all the lengths of the two drag lines 10 and 12 are by means of the respective winches decreased such that the angle between the hingedly joined drag pipe sections 3 and 4 will stay within the predetermined limit values. After the drag pipe has reached the horizontal position also the length of the drag line 14 is decreased by means of the respective winch such that the drag pipe as a whole is maintained in an almost horizontal position apart from a predetermined small angle with respect to the horizontal, in which position the drag pipe rises above the water surface and the water will flow out of the drag pipe. Thereafter the lengths of the three drag lines 10, 12 and 14 are decreased by means of the respective winches until the curve section 5, 6 has reached the curve wagon 16 and the hinged joint 8 and the drag head 9 are raised to a predetermined height with respect to the davits 13 and 11 respectively. Also in this phase of the movement the angle between the drag pipe sections 3 and 4 is watched constantly.

Finally the davits 11 and 13 are moved inwardly to the position shown in FIG. 2 in dotted line and simultaneously the curve wagon 16 is moved inwardly along the rail 17. The drag pipe is now positioned just above the gantries 15 and by increasing the length of the drag lines 10 and 12 the drag pipe will come to rest in the gantries 15 and the curved section 5,6 will be supported by the locked curve wagon 16.

Figure 4:
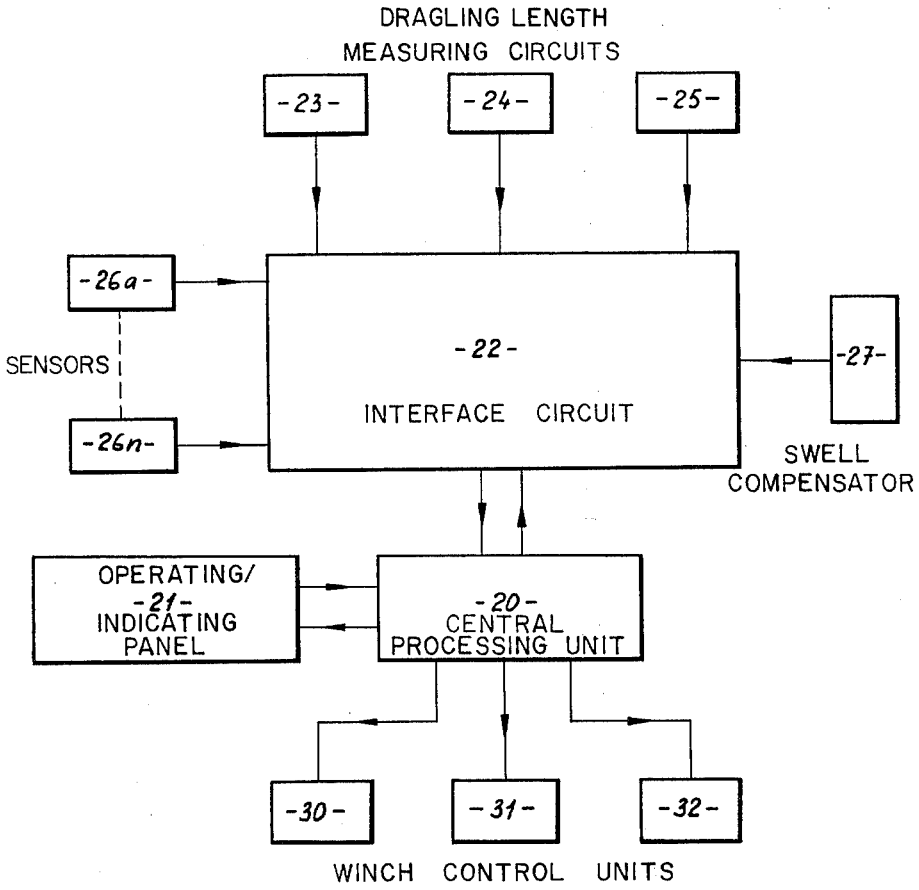
FIG. 4 shows a block diagram of the electronic control unit.

FIG. 4 shows a block diagram of the electronic control unit. Said control unit consists of the central processing unit 20, the operating panel/indication panel 21 and the interface circuit 22. Said interface circuit 22 receives signals from the measuring circuits 23, 24 and 25 each connected to one of the winches for measuring the length of drag line unwound from the respective winch. Furthermore a number of switches and sensors are connected to said interface circuit 22 which switches and sensors are schematically denoted by **26*a* until 26*n*. To said group of switches and sensors belong for instance switches positioned in the gantries 15 indicating if the drag pipe is resting in the gantry 15 or not, switches belonging to the gantries 15 and the curve wagon 16 indicating if the curve wagon 16 is locked and if the drag pipe is clamped in the gantries 15. Furthermore switches and sensors could be used to indicate that the davits have reached their inboard or outboard position or are moving between said positions. Furthermore switches could be used to indicate the fact that one of the drag lines 10 or 12** or both of said drag lines are moving to a position sideways of the vertical position with such a deviation that it is clear that the drag pipe in the transverse direction is moving too far under the ship or too far from the ship.

Furthermore the interface circuit 22 receives signals from the swell compensator 27.

The interface circuit could for instance comprise temporary memories and a multiplexer to transmit data from the interface circuit 22 to the central processing unit 20 or can contain other suitable means to transport data from and to the central processing unit. The central processing unit 20 calculates from the received data and from previously inputted fixed data, for instance related to the mutual distance between the davits 11 and 13 and the mutual distance between the davit 13 and the curve wagon 16, and the depth to which the curved section 6, 5 is lowered, continuously the momentary position of the drag pipe.

During the lowering of the drag pipe the central processing unit controls, based on the calculated position of the drag pipe, the three winches by means of the three winch control units 30, 31 and 32 such that the angle between the drag pipe sections 3 and 4 will not pass one of said predetermined limit values.

During the raising of the drag pipe the central processing unit 20 controls the winches through said respective winch control units 30, 31 and 32 such that also during the raising periods the angle between the drag pipe sections 3 and 4 will not pass one of said predetermined limit values.

If one of the switches or sensors 26*a* . . . 26*n* is activated due to in correct functioning of one of the elements of the total system, for instance when the curve wagon 16 for some reason sticks in the rails and stops moving or one of the winches is not functioning correctly, then the central processing unit will control the still functioning parts of the whole system on the basis of a previously inputted program such that the malfunctioning of one of the parts of the total system will not cause a dangerous situation so that the chances of damaging the installation are as small as possible.

Not only during the lowering or raising of the drag pipe the angle between the drag pipe sections 3 and 4 will be monitored, but also during the dredging the position of the drag pipe will be constantly monitored. It is thereby furthermore possible to determine a maximum depth for the drag head 9, so that excessive dredging can be avoided. If for instance a channel has to be dredged to a certain depth, then it is possible that there are in said channel before dredging already parts with a greater depth than the prescribed dept. It is not necessary to dredge said places. If before dredging a maximum depth value is stored in to the electronic control unit then said control unit takes care that the drag head is not lowered farther than said maximum depth, so that excessive dredging is avoided.

It is furthermore possible, for instance by means of a suitable sensor, to measure the draught of the ship during dredging. It will be clear that during dredging the draught of the ship as a whole is changing when the volume of dredged material in the hold of the ship increases. By continuously measuring the draught of the ship it is possible to adapt the depth adjustment of the drag head continuously to the changing draught. The electronic control unit calculates therefore continuously the corrected position and respective control signals are delivered to the winch control units 30, 31 and 32.

In a similar way a correction for tide differences is possible. When before the start of the dredging procedure the information on the local tides is inputted in the electronic control unit by means of the operating panel 21 then it is possible to take said local tides into account by the calculations made in the electronic control unit.

Practice has proven that for every type of soil there is a certain position of the drag pipe in which an optimum material production of the dredging process is achieved. Before starting the dredging process it is therefore possible to input the relevant data about the type of soil to be dredged by means of the operating panel 21 in the electronic control unit and to store a suitable program in the electronic control unit such that for each type of soil the position of the drag pipe can be adjusted within the predetermined limit values for the drag pipe position.

Furthermore, possible stretching of the drag lines can be corrected. Every time the drag head is positioned on the gantries in the fixed position inboard the ship, then the measuring circuits 23, 24 and 25 are adjusted to zero so that possible stretching of the drag lines resulting from the preceding dredging procedure is automatically corrected. Furthermore it is possible to use the electronic control unit according to the invention in a mode, in which the drag pipe is controlled by hand, but wherein the electronic control unit is continuously calculating, based on the received measurements and sensor data, whether a situation has occurred in which the drag pipe could be damaged. Only in that case the electronic control unit interferes and controls the winches and/or davits such that a safe condition is reached.

The measuring circuits 23, 24 and 25 for measuring the unwound lengths of the drag lines 10, 12 and 14 preferably contain a sensor with a toothed wheel coupled to the shaft of the respective winch. Because the length of the unwound drag line from a winch is directly related to the number of revolutions of the winch drum it is possible to measure the unwound drag line length by measuring the number of revolutions and parts of a revolution with a predetermined accuracy. If for instance the circumference of the winch drum is 1 m and on the shaft of the winch drum, a toothed wheel with 20 teeth is positioned, then each tooth corresponds with a drag line length of 1 m: 20=5 cm. When a detector is positioned along-side said toothed wheel for counting the number of teeth passing said detector in the one direction or in the other direction, it is possible to measure the unwound cable length with a certain accuracy (in this example in discrete increments of 5 cm).

It will be clear that the electronic control unit has to be suitably programmed such that the electronic control unit can carry out all its functions correctly. The details of said programming are conventional and so will not be described.

It will furthermore be clear that various modifications can be made within the scope of the invention. It is for instance possible to measure the unwound drag line length in other ways and with greater or lesser accuracy, or it is possible to analog measure said length using an analog-to-digital converter for feeding data into the control unit.

We claim:

1. In a dredge having a drag pipe comprised by a number of pipe sections interconnected by hinged joints, drag lines connected to said hinged joints and to the front and rear end of the drag pipe, vertical guide elements on the side of the ship that rotatably and vertically movably support the front end of the drag pipe, a drag head on the rear end of the drag pipe, and means for moving the drag pipe outboard and inboard; the improvement comprising means for separately measuring the length of each drag line unwound from the associated said winch, an electronic control unit that controls the position of the drag pipe on the basis of said measured lengths, such that the angle between the hingedly joined drag pipe sections is maintained between predetermined limit values under all circumstances, and means to control the inclination of the rear section of the drag pipe during dredging to adapt the drag pipe to optimum output of material from the dredging operation dependent on the type of soil of the bottom to be dredged.

2. A dredge as claimed in claim 1, in which said electronic control unit controls the winch of the drag line connected to the rear end of the drag pipe such that the drag head is not lowered beyond a predetermined depth.

3. A dredge as claimed in claim 1, and means to sense the draft of the dredge and to feed to said electronic control unit a draft signal, said control unit raising the drag pipe with increasing draft.

4. A dredge as claimed in claim 1, and means to sense the water depth and to send to said electronic control unit a water depth signal, said control unit lowering the drag pipe with increasing water depth.

5. A dredge as claimed in claim 1, said electronic control unit being adapted to be reset to zero when said drag lines are wound in thereby to compensate for stretch in the drag lines resulting from a preceding dredging operation.

* * * * *